US006503323B1

(12) United States Patent
El-Becha et al.

(10) Patent No.: US 6,503,323 B1
(45) Date of Patent: Jan. 7, 2003

(54) JET STRIPPING APPARATUS

(75) Inventors: Bechara El-Becha, Gwynnville (AU); Cat Tu, Balgownie (AU)

(73) Assignee: BHP Steel (JLA) Pty Ltd., Sydney (AU)

( * ) Notice: Subject to any disclaimer, the term of this patent is extended or adjusted under 35 U.S.C. 154(b) by 0 days.

(21) Appl. No.: 09/719,751

(22) PCT Filed: May 25, 1999

(86) PCT No.: PCT/AU99/00408

§ 371 (c)(1),
(2), (4) Date: Jan. 30, 2001

(87) PCT Pub. No.: WO00/01861

PCT Pub. Date: Jan. 13, 2000

(30) Foreign Application Priority Data

Jun. 30, 1998 (AU) ..... PP4419

(51) Int. Cl.[7] ..... B05C 11/06
(52) U.S. Cl. ..... 118/63; 427/348
(58) Field of Search ..... 118/63; 427/348; 15/306.1, 309.1, 309.2; 228/20.1

(56) References Cited

U.S. PATENT DOCUMENTS 3,681,119 A * 8/1972 Reid et al. ..... 118/63
4,347,805 A 9/1982 Ernest

FOREIGN PATENT DOCUMENTS

AU 71753/87 A 11/1987
DE 42 08 558 C1 3/1993

OTHER PUBLICATIONS

JP 63–153254A (Sumitomo Metal) Jun. 25, 1988 (Patent abstracts of Japan, C 541 p. 138).
JP 06–158261A, (Nippon Steel) Jun. 7, 1994 (See all drawings and and Patent Abstracts of Japan, C1249, p. 42).
JP 10–036953A (Daido Steel Sheet Corp) Feb. 10, 1998 (See all drawings and JPO Patent abstracts of Japan).
JP 10 183325A (Nisshin Steel) Jul. 14, 1998 (JPO Patent Abstracts of Japan).

* cited by examiner

*Primary Examiner*—Laura Edwards
(74) *Attorney, Agent, or Firm*—Miles & Stockbridge P.C.; John C. Kerins

(57) ABSTRACT

A flow diversion device is provided for use in a gas jet stripping apparatus and includes a baffle having a first portion which, in use, extends longitudinally of the moving strip which is being subjected to the stripping action of the jet stripping nozzles of gas jet stripping apparatus. The baffle further includes a second portion which diverges away from the moving strip and a gas outlet for providing gas to the strip side of the baffle. The baffle also has gas collection vanes for redirecting gas from the stripping nozzles to the gas outlet.

18 Claims, 8 Drawing Sheets

JET STRIPPING APPARATUS

FIELD OF THE INVENTION

The invention relates to improvements in the apparatus for the continuous application of a liquid coating to a substrate strip. The invention is applicable to apparatus generally, in which a substrate strip is coated with a coating composition, but was devised primarily for use in the continuous metal coating of steel strip (wherein the liquid coating is molten zinc or molten aluminium zinc alloys) or the continuous coating of steel strip with other liquid coatings such as terne or polymeric paint compositions.

BACKGROUND

It is commonplace in such apparatus firstly to apply an over thick layer of liquid coating material to the strip at a coating station and then strip surplus material from the over thick layer to the required thickness for the finished coat. The reduction of the over thick layer is generally carried out using a gas jet stripping apparatus.

Gas jet stripping apparatus of the prior art include two elongated nozzles disposed one on either side of the strip's pass line, which direct sheetlike jets of gas against the respective sides of the thickly coated strip. The two nozzles extend transversely of the strip at right angles to the direction of strip travel. Each gas jet impinges normally or at a certain angle sometimes as large as 30° to the strip, and splits into two gas streams flowing over the surface of the strip. One such stream flows in the direction of strip travel and the other flows in the opposite direction. Thus, one of the streams flow counter to the oncoming over thick layer and blows material from the layer back upon itself. The net effect is to prevent all but a thin layer of coating material in close adherence to the substrate strip from travelling with the strip past the nozzles.

For any particular installation, each nozzle is at least as long as the maximum width of strip that may be processed by the installation. Thus, whenever strips of lesser width are being processed, the nozzles extend beyond the edges of the strip. It follows that, beyond the edges of the strip, the end portions of the gas jets meet in opposition, producing a turbulent flow pattern adjacent to the strip edges.

Previously, it has been proposed to modify the traditional gas jet stripping apparatus by the addition of a baffle to a courier plate adjacent each of the strip edges and disposed between the nozzles of the opposed gas jets. The courier plate extends from the vicinity of the strip edge to the maximum strip width and is disposed between the counter flowing gas stream beyond the strip edges.

Each such baffle is a rigid flanged edge having a first portion which extends longitudinally of the strip adjacent a longitudinal edge of the strip, and a second portion, being an extension of the first portion, which diverges away from the edge of the strip in the upstream direction of the strip. The first portion of the flanged edge is spaced a small distance from the longitudinal edge of the strip to allow an unhindered passage of the strip past the baffle.

The effect of the baffle is to contain the stripping counter flowing gas stream (and shield it from the above mentioned turbulence) until such time as the stripping gas stream reaches the second portion of the baffle. In addition, the stripping gas stream adjacent the baffle then tends to follow the diverging second portion of the baffle and thus sweeps across the edge of the strip. In so doing it carries coating material from the margin across the edge and discharges it from the strip as free droplets, so reducing the marginal coating thickness.

To improve the tendency of the stripping gas flow adjacent the strip to follow the diverging second portion of the baffle, there has been proposed in the applicant's co-pending application No. PCT/AU98/00346, the whole contents of which are incorporated by reference, a flow diversion device including a baffle secured to a plate having a longitudinally extending first portion, a diverging second portion and a gas supply duct for providing gas from an external source to the strip side of the baffle. While the supply of gas to the strip side of the baffle in the region of the second portion of the baffle achieves the desired objectives, the supply of gas from an external source at or above 200 kilopascals above ambient pressure is an additional operating cost.

SUMMARY OF THE INVENTION

To improve the operation of the above-mentioned flow diversion device and gas jet stripping apparatus, the applicant has proposed an improvement which is able to utilise the gas from the gas jet nozzles directed at the flow diversion device to supplement or replace the externally sourced gas provided to the strip side of the baffle.

Accordingly the invention provides a flow diversion device in a gas jet stripping apparatus having a pair of opposed gas jet stripping nozzles defining a stripping region, the device being positionable adjacent a moving strip in the stripping region and including a baffle having a first portion extending longitudinally of the strip adjacent the longitudinal edge of the strip and a second portion diverging away from the edge of the strip, a gas outlet for providing gas to the strip side of the baffle, and a gas collection means for redirecting gas from the stripping nozzles to the gas outlet.

When a strip having a width less than the maximum width is used, the flow diversion device is used between the nozzles from the strip edge to the maximum width primarily to reduce the noise and turbulence associated with the meeting of counter flow gas streams. The flow diversion device according to the invention is also able to utilise the gas streams directed at the plate by collecting the gas and preferably directing it towards the gas outlet. The gas collection means preferably includes at least one gas collection conduit having vanes for collecting and diverting gas from said stripping nozzles towards said gas outlet.

The at least one gas collection conduit may be positioned in the stripping zone of the stripping nozzles. Alternatively, the at least one gas collection conduit may be positioned above and/or below the stripping zone of the stripping nozzles to collected gas which has been diverted towards the conduit as a result of contact with the plate.

It is preferable for at least one gas collection conduit to be provided on each side of the plate.

Each of the gas collection conduits is preferably in the form of a conduit with a plurality of vanes to redirect gas from the gas nozzles towards the gas outlet.

In one embodiment, the conduit is positioned along the lowermost edge of the plate, the conduit having vanes on each side of the plate to redirect gas from the stripping nozzles via the gas outlet towards the moving strip.

In many instances, the amount of gas collected and directed towards the gas outlet may be insufficient to enable the baffle of the flow diversion device to operate effectively. Hence, an auxiliary gas supply may be provided to the conduit to supplement the volume of gas passing through the outlet.

In another aspect of the invention, each of the gas supply conduits may be provided with a hood extending up to and preferably contacting the stripping nozzle outlets to essentially enclose the gas passage from the stripping nozzles to the gas outlet. In this way the collection of gas from the stripping nozzles is maximised.

In a preferred form of the invention the baffle of the flow diversion device is secured to the strip side edge of a plate, the plate extending away from the strip between the opposed stripping nozzles.

In another aspect of the invention, there is provided a gas jet stripping apparatus for reducing the thickness of the liquid coating on a moving strip including a pair of opposed gas jet stripping nozzles defining a stripping region and a flow diversion device for positioning between the stripping nozzles in the stripping region and adjacent the moving strip, the flow diversion device including a baffle having a first portion extending longitudinally of the strip adjacent the longitudinal edge of the strip and a second portion diverging away from the edge of the strip, a gas supply outlet for providing gas to the strip side of the baffle, and a gas collection means positioned between the stripping nozzles for redirecting gas from the stripping nozzles to the gas outlet.

The gas jet stripping apparatus according to the invention is able to utilise gas which would normally have been waste gas to reduce or eliminate edge build-up of coating material on the strip.

DESCRIPTION OF THE PREFERRED EMBODIMENTS

Figure 1:
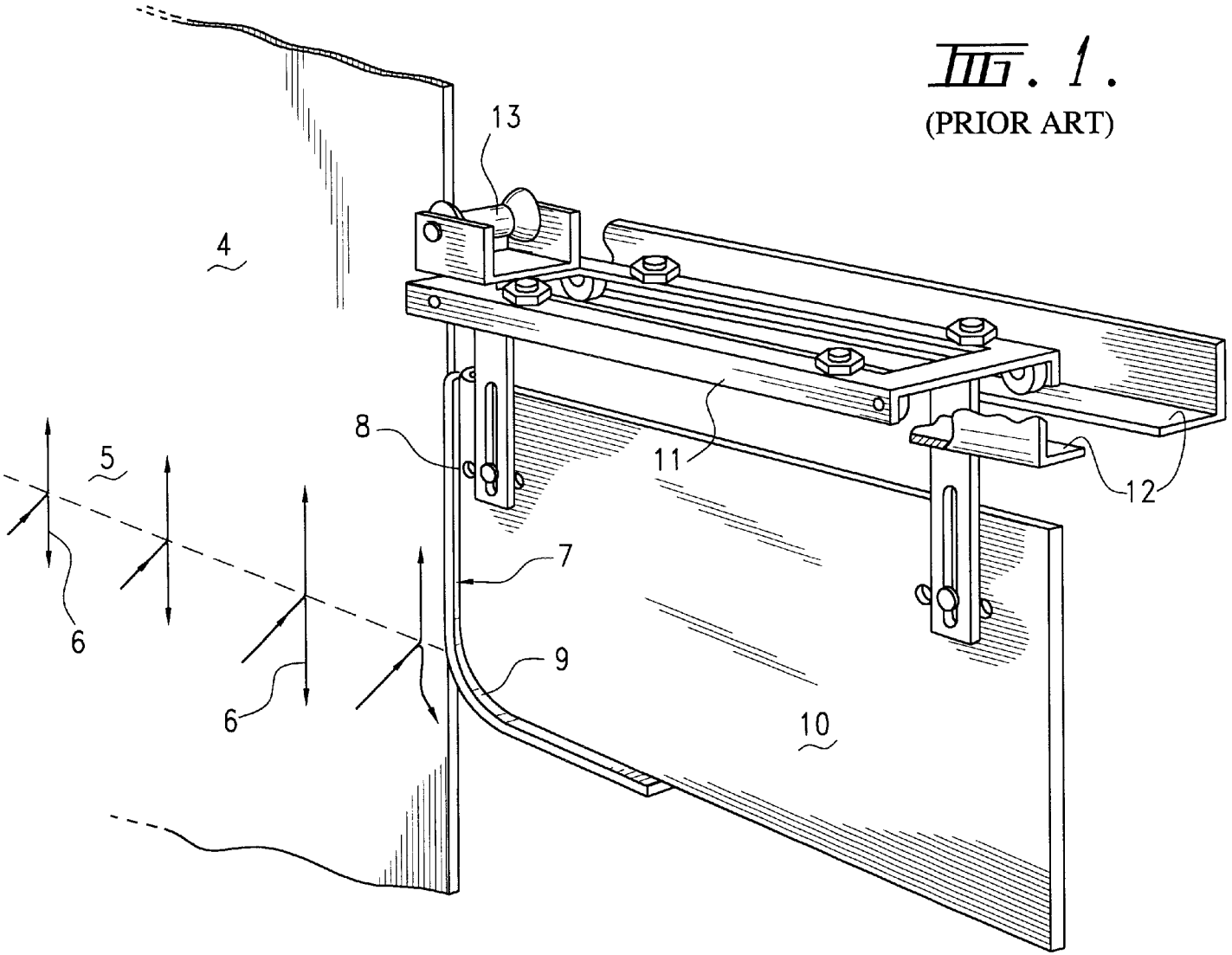
FIG. 1. (PRIOR ART)
FIG. 1 is a perspective view of a prior art gas flow diversion device.

The prior art gas flow diversion device of FIG. 1 is typical of those found in a steel strip galvanising or similar metal coating line. The strip 4 being coated is shown rising vertically as from a hot dip coating pot (not shown). On leaving the pot the strip is covered with an over thick layer of a molten metal or metal alloy coating. Two sheet like stripping jets of gas, for example air, steam or nitrogen, are directed respectively at the sides of the strip 4 by elongated nozzles (not shown) extending transversely of the sheet on opposite sides thereof. The jet on the side of the sheet that is visible in the Figure impinges on that side along the broken line marked 5 to define a stripping region and divides into two gas streams, as indicated by the arrows in the Figure. One stream is directed upwardly or in the direction of the moving strip and the other, referred to herein as the counter flowing gas stream and referenced 6, is directed downwardly or in the counter direction of strip movement. The counter flowing gas stream 6 is responsible for the stripping effect by blowing coating material downwardly or in the counter direction towards the dipping pot. The stripping jets directed at the hidden side of the sheet 4 are in register with the jets shown in FIG. 1.

The prior art flow diversion device shown in FIG. 1 includes a baffle 7, being a metal strap with a width dimension perpendicular to the plane of the strip 4 and having a first portion 8 extending longitudinally of the adjacent edge of the strip 4 and a second portion 9, being an extension of the first portion 8, of a curved or arcuate shape diverging from the edge of the strip 4 in the counter direction of strip movement The baffle 7 may be supported by a carrier plate 10 lying substantially in the plane of the strip 4 and suspended from a carriage 11, able to move along rails 12 defining a travel path for the carriage 11 that also lies in the plane of the strip 4.

The carriage is loaded towards the strip 4 by any suitable means (not shown). The operating position of the carriage is thus determined by a buffer roller 13 on the carriage 11 in contact with the edge of the strip 4. The position of the roller 13 is such that when the carriage is in its operating position, the first portion 8 of the baffle 7 is just clear of the edge of the strip 4.

The carrier plate 10 not only supports the baffle 7, but also acts as an extension of the strip 4 between the stripping jet portions lying outboard of the strip edges when the width of the strip is less than the span of the nozzles. This markedly reduces the noise that is otherwise produced by the meeting of the two opposed jets.

It will be appreciated that a gas flow control device which is the mirror image of those illustrated and described above may be provided at the opposite edge of the strip 4 not shown in FIG. 1.

Figure 2:
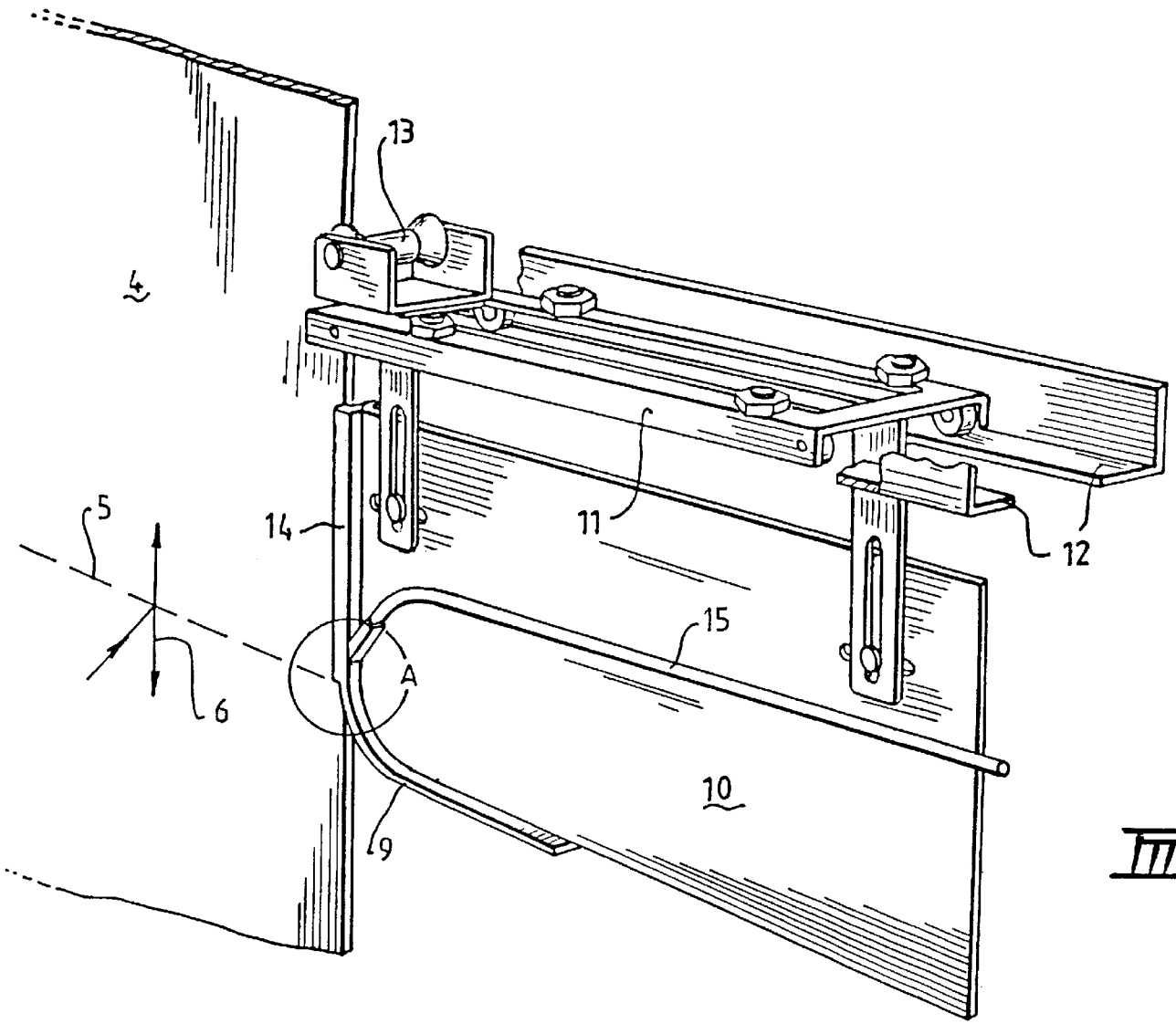
FIG. 2 is a perspective view of an embodiment of a gas flow diversion device in accordance with PCT/AU98/00346.
Figure 3:
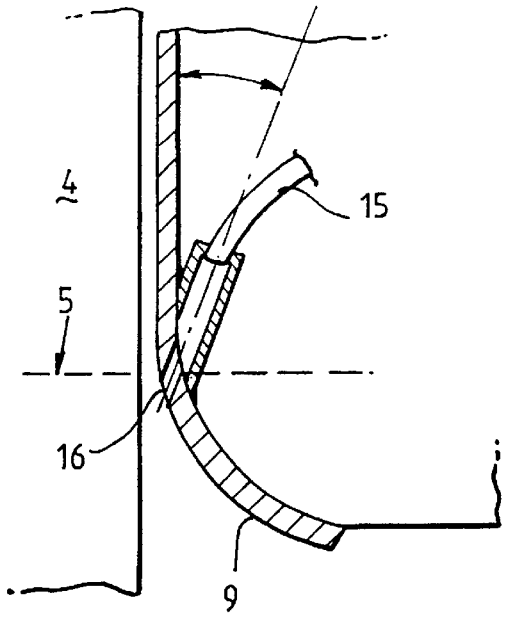
FIG. 3 is an enlarged sectional view of region A in FIG. 2.

As discussed in co-pending application No. PCT/AU98/00346, and illustrated in FIGS. 2 and 3, the provision of gas through a gas supply duct 15 to the strip side of baffle 14 through an outlet 16 in the baffle causes the gas in the vicinity of the edge region of the strip to be drawn away from the strip 4 and follow the diverging portion 9 of the baffle. In this way, the turbulence from the counterflowing gas stream in the vicinity of the edge region of strip 4 and the edge build up is greatly reduced.

Figure 4:
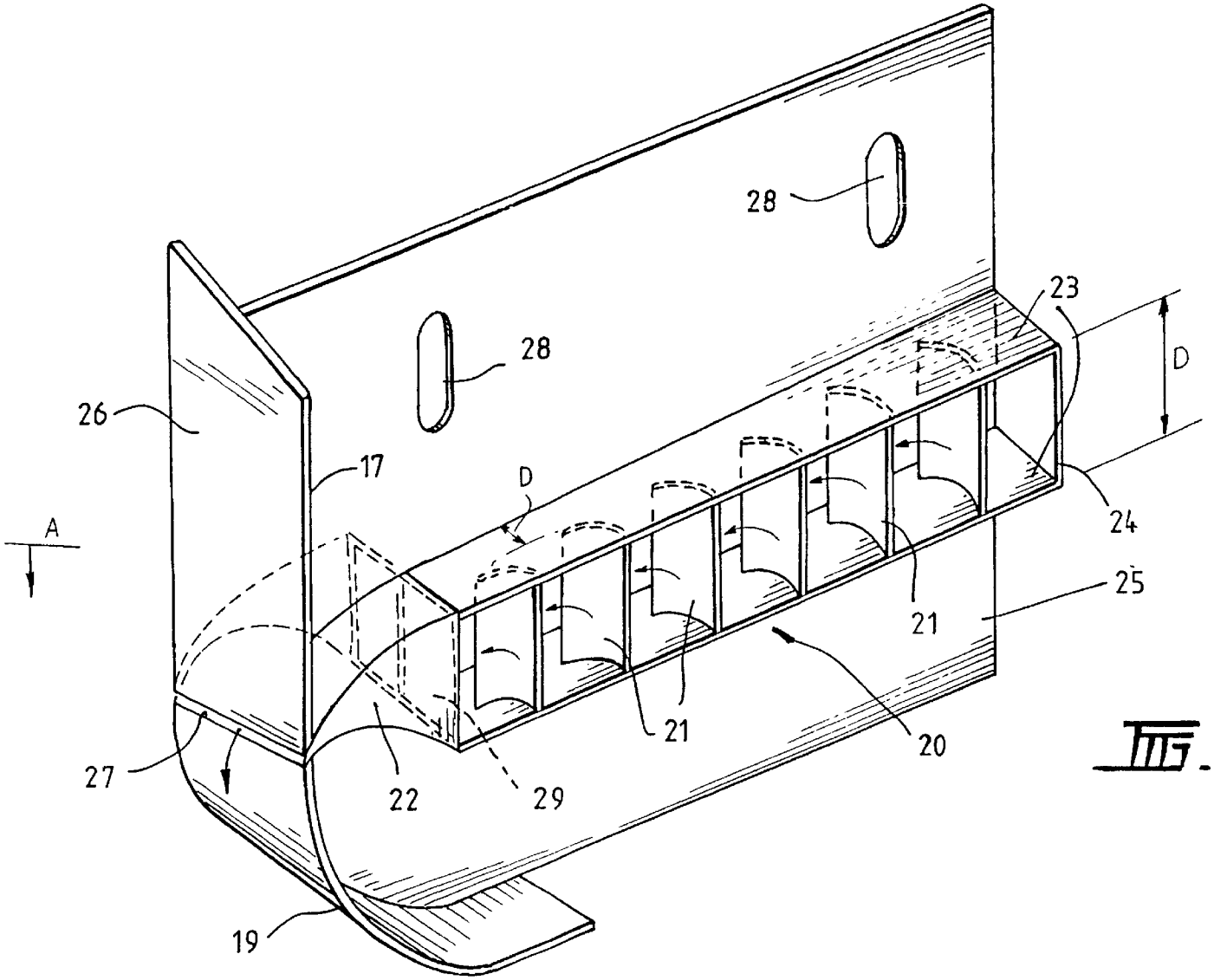
FIG. 4 is a perspective view of an embodiment of the gas flow diversion device in accordance with the present invention.

The gas diversion device in accordance with an embodiment of the invention illustrated in FIG. 4 includes a baffle 26 secured to the strip side edge of plate 25 having a first portion 17 which in use extends longitudinally of the strip and a second portion 19 which diverges away from the moving strip 4 in the direction counter to the movement of the strip. The flow diversion device according to the present invention differs from the prior art illustrated in FIGS. 1, 2 and 3 by the addition of a gas collection means extending laterally in the width dimension of the baffle. In the embodiment of FIG. 4, the gas collection means 20 is positioned in the stripping region between the stripping nozzles (not shown) for redirecting the gas from the stripping nozzles to the gas outlet 27. The gas collecting means 20 is positioned in the stripping region of the gas jet stripping apparatus outside the coating reducing region where the gas from the stripping nozzles is usually supplied at a pressure of less than 15 kPa for low density alloys and as high as 55 kPa for coatings of higher density to achieve certain coating classes. The gas means includes a collection conduit 24 having a plurality of gas redirection vanes 21 shaped to redirect gas from the jet stripping nozzles (not shown) towards the gas outlet 27. The gas is prevented from escaping the effects of the redirecting vanes 21 by the sides 23 of conduit 24.

While the vanes may be the same shape and have the same orientation, it is preferred that the vanes have an increasing clearance distance D in the direction towards the gas outlet 27 to allow for the accumulating increasing gas flow in the conduit towards the outlet end of the conduit. Additionally the shape and exit angle of the vanes 21 may be altered along conduit 24 to minimise the interference or impact between the cross flow of accumulating gas along the conduit and the flow of gas introduced into the conduit at the particular vane.

The gas collected in conduit 24 preferably passes through inlet 29 into a duct 22 which communicates with outlet 27. Gas outlet 27 is preferably provided in proximity to where the first portion 17 of baffle 26 meets the second portion 19. The gas outlet 27 is preferably positioned in the stripping region between the stripping nozzles of the gas jet stripping apparatus. Hence in this embodiment, the position of the outlet 27 and the angle at which the gas leaves the outlet are not totally independent as in the case of a totally external compressed gas supply since the collection of gas for the edge build up reducing action takes place within the stripping region. Since the gas flow for the edge build up reducing action is simply a collection of gas from outside the coating reducing region of the jet stripping nozzles, the width B of the vanes 21 and collection conduit 24 must be sufficiently large to ensure that all of the gas from the nozzles is utilised.

Figure 7:
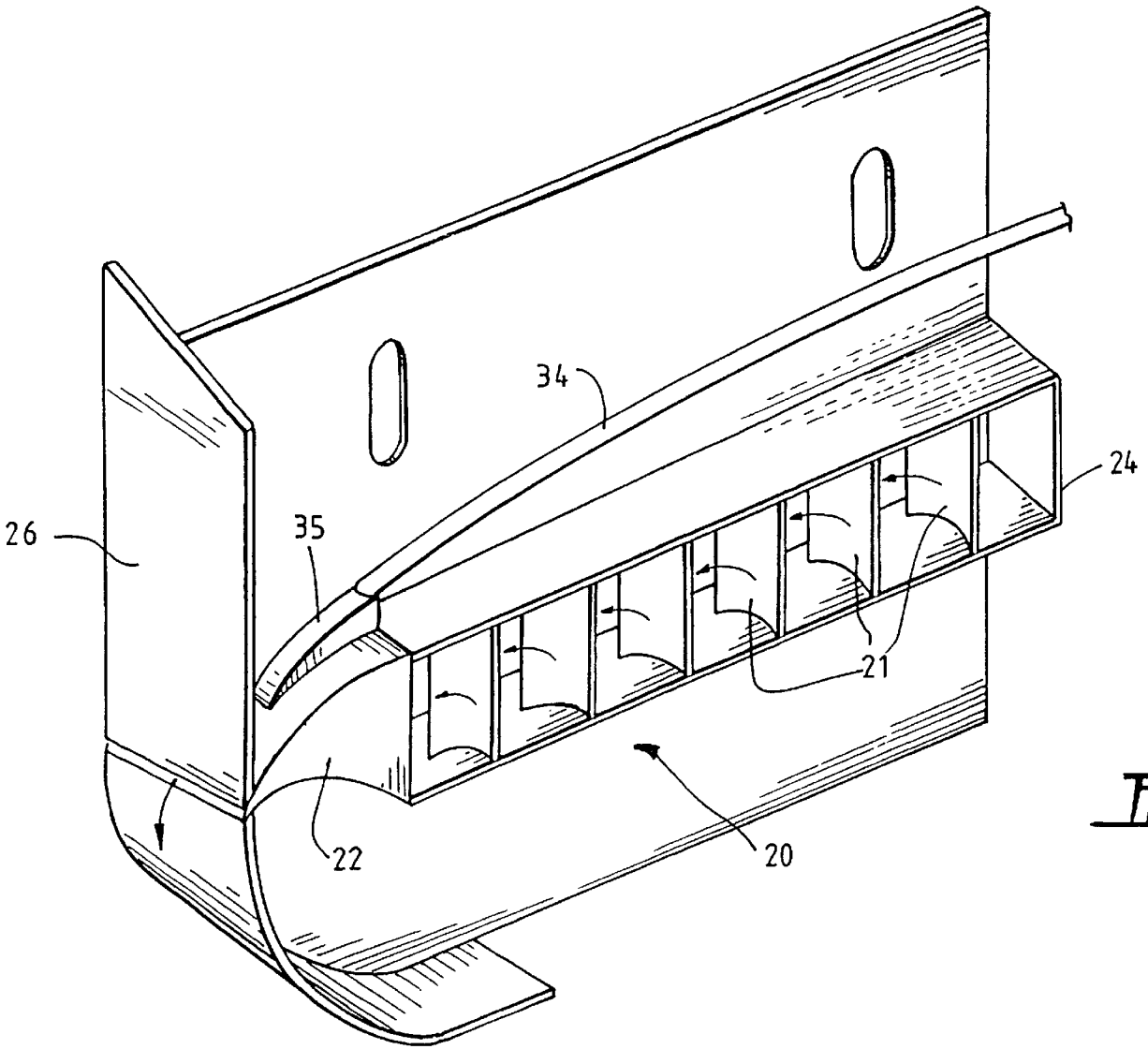
FIG. 7 is a perspective view of a second embodiment of the present invention.

While it is preferable that all of the gas for the edge build up reducing action is provided by the stripping nozzles, it is within the scope of the invention that an external supplementary or auxiliary gas supply 34 may be connected via inlet 35 to the top of chamber 22 to supplement the gas exiting gas outlet 27 as shown in FIG. 7. To balance the supply of external supplementary gas, an inlet may also be provided on the reverse side of plate 10.

Figure 5:
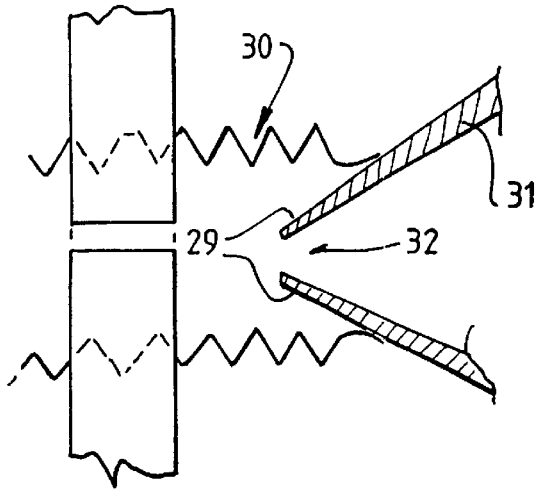
FIG. 5 is an embodiment of a hood extending from the gas flow diversion device.
Figure 6:
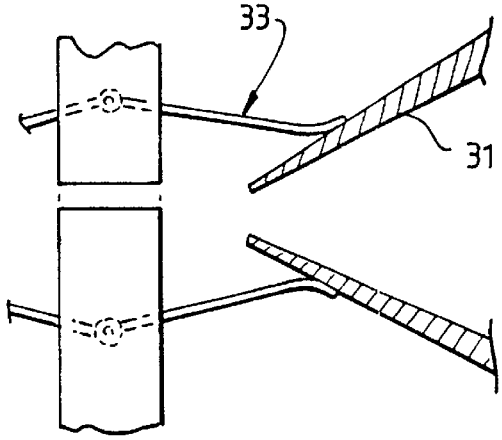
FIG. 6 is a second embodiment of a hood extending from the gas flow diversion device.

To assist the collection of gas in conduit 24 or as an alternative to the conduit, an extendable elongated hood or shroud may be provided extending from the plate or conduit 24 to at least the lip of outlet 32 in stripping nozzle 31. The hood may be a flexible extendable type 30 as shown in FIG. 5 or a more rigid type 33 as shown in FIG. 6.

The reverse side of the flow diversion device is also provided with an identical gas collection means to collect and redirect gas from the other of the pair of opposed jet stripping nozzles. In this way, the gas from both of the opposed pair of jet stripping nozzles is redirected and discharged through outlet 27 on the strip side of baffle 26.

It is within the scope of the invention that part or all of the section of the plate 25 between the gas collection conduits 20 on each side of the plate may be removed. The gas collection means will thus include a single conduit having vanes on both sides of the plate to redirect the respective gas flows from the jet stripping nozzles.

Figure 8:
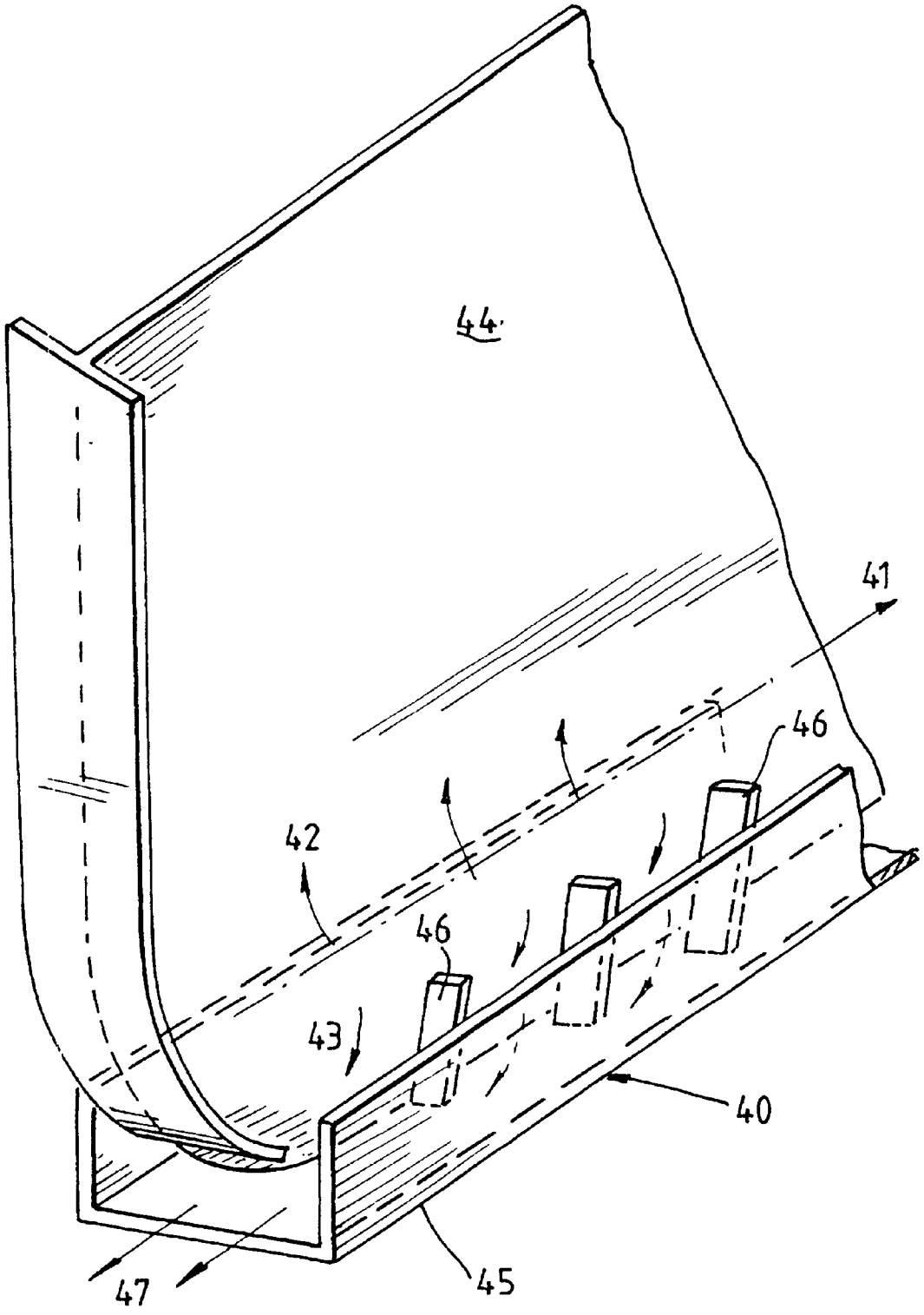
FIG. 8 is a perspective view of a second embodiment of the gas flow diversion device.
Figure 9:
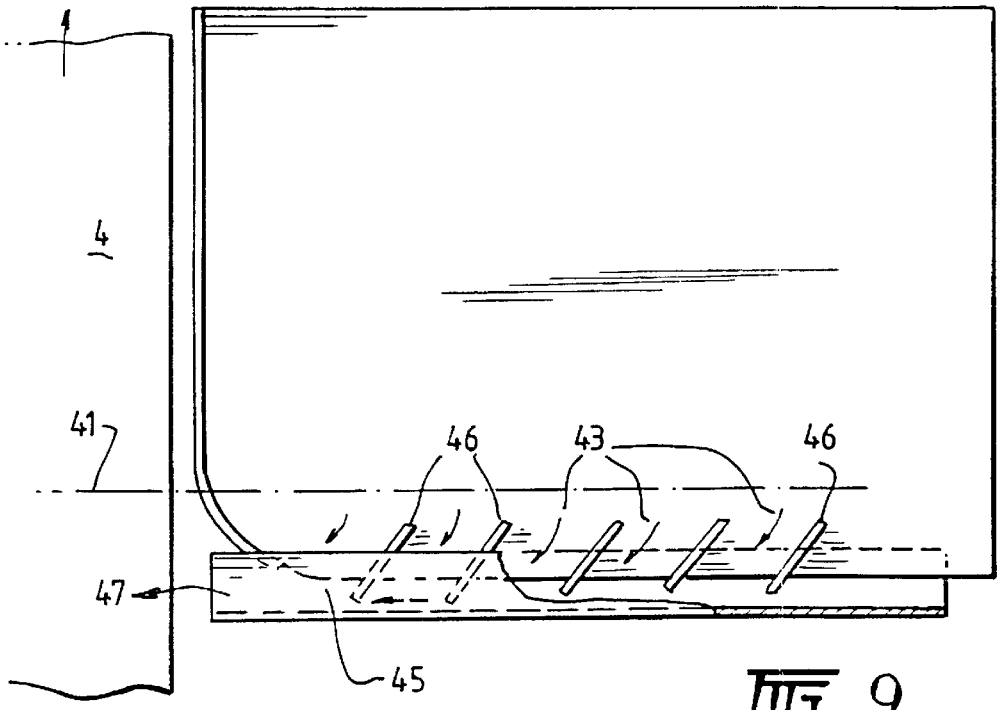
FIG. 9 is a side view of the embodiment shown in FIG. 8, FIG. 10(*a*) is a side view of a third embodiment of the gas flow diversion device, FIG. 10(*b*) is an end view of the embodiment of FIG. 10(*a*) in the direction of A—A in FIG. 10(*a*), FIGS. 11(*a–d*) are embodiments of the vane arrangements in the gas collection conduit.

A second embodiment of the invention is shown in FIGS. 8 and 9 in which the gas collection means 40 is positioned below the stripping region 41 of the jet stripping apparatus.

In the stripping region 41 which corresponds to the line of the stripping nozzles, the gas from the nozzles contacts the plate resulting in a flow of gas both in the upward 42 and downward 43 directions. The proportion of the split between the upward and downward flows of gas is dependent on the angle of incidence of the gas from the nozzles on to the plate. The gas collection means 40 shown in FIG. 8 includes a conduit 45 extending beneath the carrier plate 44. The downward flow of gas 43 is directed by vanes 46 into the conduit 45 towards the gas outlet 47 which directs gas towards the moving strip 4 as shown in FIG. 9.

The direction of the gas outlet 47 is shown as being substantially parallel to the line 41 of gas nozzles. However, the direction of gas outlet 47 may be set to any angle relative to the strip edge. Additionally, the cross section of the outlet 47 may have a convergence to increase the exit velocity of the gas. The vanes 46 in the bottom conduit can be made progressively smaller and provide greater clearance from the bottom of the conduit as the position of these vanes is closer to the gas outlet to allow for an increase in the gas volume without increasing the pressure in the gas conduit closer to the gas outlet.

Figure 10:
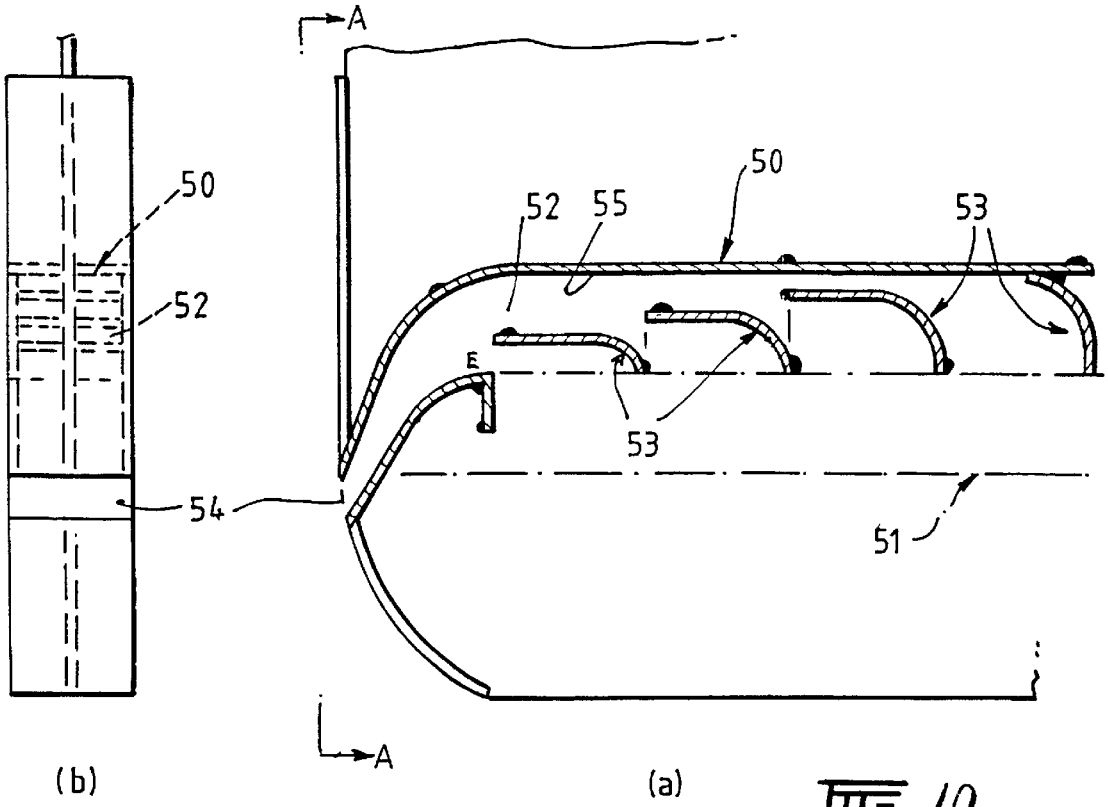

In the embodiment of FIGS. 10(*a*) and 10(*b*), the gas collection means 50 is positioned above the stripping region 51 and thus only collects the gas which flows upwardly after contacting the carrier plate. The collection means 50 includes a gas conduit 52 having a plurality of vanes 53 which collect and redirect the gas towards gas outlet 54. The vanes closer to the gas outlet, are provided with progressively greater clearance from the side 55 of the conduit 52 to accommodate an increasing gas volume closer to the gas outlet without increasing the pressure in the gas conduit closer to the gas outlet. As shown in FIG. 10(*b*), gas conduits are provided on both sides of the carrier plate to redirect gas to common gas outlet 54.

Figure 11:
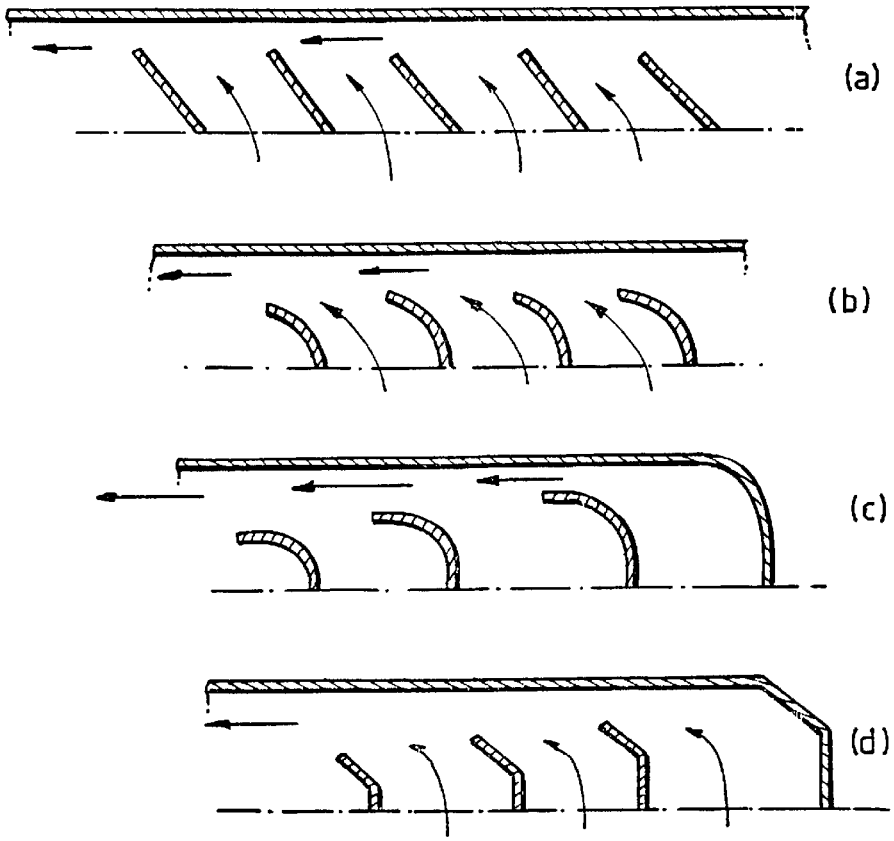

In FIGS. 11(*a*) to 11(*d*), a number of alternative vane shapes and configurations to redirect collected gas towards the common outlet are shown. The vanes in the gas collection conduits may be fixed in position or may be adjustable to accommodate changing gas flows resulting from variable pressures in the gas jet stripping nozzles.

In the embodiment shown in FIG. 10, only the upward flow of gas is collected. This allows some gas from the stripping nozzles to flow downwardly in the direction of the coating pot after contact with the carrier plate. This downward flow of gas has the advantage of clearing the dross which forms on the top of the pot thereby reducing the amount of dross picked up by the moving strip as it emerges from the pot. In some instances, this downward flow of gas can be an advantage, but this advantage comes at the expense of the gas collection efficiency of the gas collection means.

Figure 12:
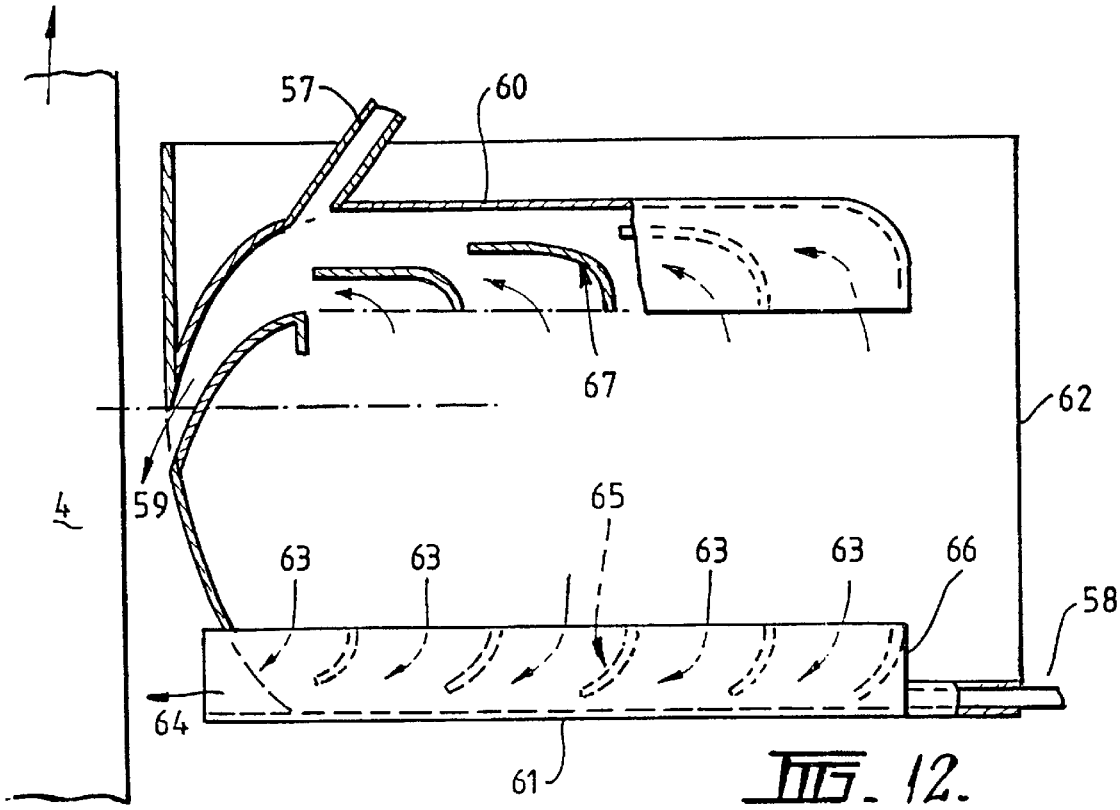
FIG. 12 is a side view of a fourth embodiment of the flow diversion device.

In the embodiment shown in FIG. 12, a flow diversion device having a gas collection means which collects and redirects both the upwardly and downwardly flowing gas flows is shown. In this embodiment, both the top collection conduit 60 and the bottom collection conduit 61 are shown connected to optional auxiliary gas supplies 57, 58. The auxiliary gas supply can be directed into the collector conduit at any point in the conduit depending on the vane and conduit shapes and the gas velocities and volume.

As with the embodiment of FIG. 10, there are preferably two gas collection conduits 60 which redirect upwardly flowing gas on both sides of the carrier plate 62 towards a common outlet 59.

The bottom gas collection conduit 61 is similar to the embodiment of FIGS. 8 and 9 in that the conduit 61 extends beneath both sides of the carrier plate 62 to collect a redirected downwardly flowing gas 63 on both sides of the carrier plate towards a gas outlet 64 in the direction of the moving strip 4.

Similar to the embodiment of FIGS. 8 and 9, in the embodiment shown in FIG. 12, the vanes 65 in the bottom conduit can be made progressively smaller and provide greater clearance from the top side of the conduit as the position of those vanes is closer to the gas outlet. This allows for an increase in the gas volume without increasing the pressure in the gas conduit closer to the gas outlet. The vane 66 furthermost from the gas outlet may still provided with some clearance from the wall of the gas collection conduit to allow passage of auxiliary gas when used through supply line 58. While the position of the auxiliary gas supply 58 is shown as being located at the end of conduit 61, the auxiliary gas supply line may be located anywhere along conduit 61.

In the upper gas collection conduit the optional auxiliary gas supply 57 is shown feeding into a gas supply duct which receives the collected gas which has been redirected by vanes 67. The location of the auxiliary gas supply line 57 may be anywhere along the conduit 60 at an appropriate angle.

By providing a gas collection means on the carrier plate, the invention is able to effectively utilise the gas from the gas jet stripping nozzles directed towards the flow diversion device which would otherwise have been wasted.

What is claimed is:

1. A flow diversion device adapted to be used in a gas jet stripping apparatus having a pair of opposed gas jet stripping nozzles defining a stripping region, said flow diversion device being positionable adjacent a moving strip in the stripping region and including a baffle having a first portion extending longitudinally of the strip adjacent the longitudinal edge of the strip and a second portion diverging away from the edge of the strip, a gas outlet for providing gas to the strip side of the baffle and a gas collection means operatively coupled to the gas outlet for redirecting gas from the stripping nozzles to pass through the gas outlet.

2. A flow diversion device adapted to be used in a gas jet stripping apparatus having a pair of opposed gas jet stripping nozzles defining a stripping region, said device being positionable adjacent a moving strip in the stripping region and including a baffle having a first portion extending longitudinally of the strip adjacent the longitudinal edge of the strip and a second portion diverging away from the edge of the strip, a gas outlet for providing gas to the strip side of the baffle and a gas collection means for redirecting gas from the stripping nozzles to the gas outlet, wherein the gas collection means includes at least one gas collection conduit having vanes for collecting and diverting gas from said stripping nozzles towards said gas outlet.

3. The flow diversion device of claim 2 further including a plate secured to said baffle, said plate extending away from the strip between opposed stripping nozzles.

4. The flow diversion device of claim 3, wherein the at least one gas collection conduit is positioned in the stripping region of the stripping nozzles.

5. The flow diversion device of claim 3, wherein the at least one gas collection conduit is provided on said plate above the stripping region of the stripping nozzles.

6. The flow diversion device of claim 3, wherein the at least one gas collection conduit is provided below the stripping region of the stripping nozzles.

7. The flow diversion device of claim 4, wherein at least one gas collection conduit is provided on each side of said plate.

8. The flow diversion device of claim 7, wherein the at least one gas collection conduit is provided with a gas supply duct, the gas supply duct communicating with an auxiliary air supply.

9. The flow diversion device of claim 4, wherein the at least one gas collection conduit is provided with a gas supply duct communicating with an auxiliary air supply.

10. A gas jet stripping apparatus for reducing the thickness of a liquid on a moving strip including a pair of opposed gas jet stripping nozzles defining a stripping region and a flow diversion device for positioning between the stripping nozzles in the stripping region and adjacent the moving strip, the flow diversion device including a baffle having a first portion extending longitudinally of the strip adjacent the longitudinal edge of the strip and a second portion diverging away from the edge of the strip, a gas supply outlet for providing gas to the strip side of the baffle, and a gas collection means positioned between the stripping nozzles and operatively coupled to the gas outlet for redirecting gas from the stripping nozzles to pass through the gas outlet.

11. A gas jet stripping apparatus for reducing the thickness of a liquid on a moving strip including a pair of opposed gas jet stripping nozzles defining a stripping region and a flow diversion device for positioning between the stripping nozzles in the stripping region and adjacent the moving strip, the flow diversion device including a baffle having a first portion extending longitudinally of the strip adjacent the longitudinal edge of the strip and a second portion diverging away from the edge of the strip, a gas supply outlet for providing gas to the strip side of the baffle, and a gas collection means positioned between the stripping nozzles and operatively coupled to the gas outlet for redirecting gas from the stripping nozzles to the gas outlet, wherein the gas collection means includes at least one gas collection conduit having vanes for collecting and diverting gas from said stripping nozzles towards said gas outlet.

12. A gas jet stripping apparatus of claim 11 further including a plate secured to said baffle, said plate extending away from the strip between opposed stripping nozzles.

13. A gas jet stripping apparatus of claim 12, wherein the at least one gas collection conduit is positioned in the stripping region of the stripping nozzles.

14. A gas jet stripping apparatus of claim 12, wherein the at least one gas collection conduit is provided on said plate above the stripping region of the stripping nozzles.

15. A gas jet stripping apparatus of claim 12, wherein the at least one gas collection conduit is provided below the stripping region of the stripping nozzles.

16. A gas jet stripping apparatus of claim 13, wherein at least one gas collection conduit is provided on each side of said plate.

17. A gas jet stripping apparatus of claim 16, wherein the at least one gas collection conduit is provided with a gas supply duct, the gas supply duct communicating with an auxiliary air supply.

18. A gas jet stripping apparatus of claim 13, wherein the at least one gas collection conduit is provided with a gas supply duct communicating with an auxiliary air supply.

* * * * *